US006142438A

United States Patent [19]

Cooper et al.

[11] Patent Number: 6,142,438

[45] Date of Patent: Nov. 7, 2000

[54] FOLDING CANOPY SUPPORT BRACKET

[76] Inventors: Warren S. P. Cooper, Admiral Custom Canvas 2208 Idelwild Rd., Palm Beach Gardens, Fla. 33410; Stephen J. Carr, 42 Findon Rd., Sosport, Hampshire, United Kingdom, PO124EP

[21] Appl. No.: 09/006,531

[22] Filed: Jan. 13, 1998

[51] Int. Cl.[7] ..... A47G 29/02

[52] U.S. Cl. ..... 248/250; 160/65

[58] Field of Search ..... 248/273, 250, 248/278.1; 160/65, 81, 82

[56] References Cited

U.S. PATENT DOCUMENTS

| | | | |
|---|---|---|---|
| 584,871 | 6/1897 | Gordon | 248/278.1 X |
| 716,016 | 12/1902 | Farrand | 160/82 |
| 1,051,901 | 2/1913 | Lockhart | 160/82 |
| 1,062,434 | 5/1913 | Brooks | 248/278.1 X |
| 2,523,118 | 9/1950 | Jones | 248/278.1 |
| 2,727,707 | 12/1955 | Wells | 248/278.1 X |
| 2,793,388 | 5/1957 | Bartholomew . | |
| 2,830,835 | 4/1958 | Woodruff . | |
| 2,892,463 | 6/1959 | Frommelt et al. | 160/82 X |
| 2,940,800 | 6/1960 | Knapp . | |
| 3,006,668 | 10/1961 | Stewart . | |
| 3,031,707 | 5/1962 | Wiley . | |
| 3,423,112 | 1/1969 | Cale . | |
| 3,729,109 | 4/1973 | McCurdy | 248/278.1 X |
| 4,306,280 | 12/1981 | Burke | 248/278.1 X |
| 4,470,106 | 9/1984 | Norton | 248/278.1 X |

*Primary Examiner*—Anita M. King
*Assistant Examiner*—Kimberly Wood
*Attorney, Agent, or Firm*—Alvin S. Blum

[57] ABSTRACT

A bracket mounts against a rigid support surface for pivotally supporting an end of a tubular element of a frame for a folding awning or canopy. The pivot pin that engages the frame element is supported by a pivot pin support member that is in turn supported by two end elements that fasten to the support surface. The pivot pin support member and the two end elements are so constructed that they are free to rotate relative to one another about an axis transverse to the axis of the pivot pin. This provides greater flexibility in the folding motion of the frame element and facilitates mounting of the bracket on a non-planar surface.

9 Claims, 2 Drawing Sheets

FOLDING CANOPY SUPPORT BRACKET

BACKGROUND OF THE INVENTION

This invention relates to tubular supports for canopies and awnings and more particularly to a support bracket for pivotably supporting the end of a tubular frame on a rigid surface.

Awnings for windows and canopies for boats are generally made of a canvas fabric supported by a tubular frame. The assembly is generally mounted on a rigid support surface by brackets connected to the tubular ends. It is generally desirable to mount the assembly so that it may be folded compactly against the rigid support when not in use or in anticipation of violent weather. This usually is achieved by making the tubular, frame foldable and joining the tubular ends to the rigid surface by pivotal or hinged support brackets.

In certain frame configurations, it may be desirable to have a support bracket with more degrees of freedom than a conventional hinge or pivot because the tubular end may not move through a simple plane when folding or unfolding.

In some applications, the rigid support may not be planar. This presents a problem with conventional brackets which may have to be shimmed or adjusted to fit the surface.

SUMMARY OF THE INVENTION

It is accordingly an object of the invention to provide a pivoting bracket for supporting the tubular end of an awning or canopy frame that will better fit onto a rigid support that may not be planar. It is another object of the invention to provide such a bracket that provides additional freedom of movement for the tubular end beyond simple movement in a plane.

The bracket assembly of the invention comprises a center member with a hinge pin connection to a tubular end, and two end pieces which support the center member. The center member and the two end pieces being rotatable about a common axis that is transverse to the axis of the hinge pin. Each of the end pieces is provided with means for affixing to a rigid support surface. Because the two end pieces are rotatable relative to one another, they will better fit against a nonplanar rigid surface.

These and other objects, advantages and features of the invention will become more apparent when the detailed description is studied in conjunction with the drawings in which like reference characters designate like elements in the various drawing figures.

DETAILED DESCRIPTION OF PREFERRED EMBODIMENTS

Figure 1:
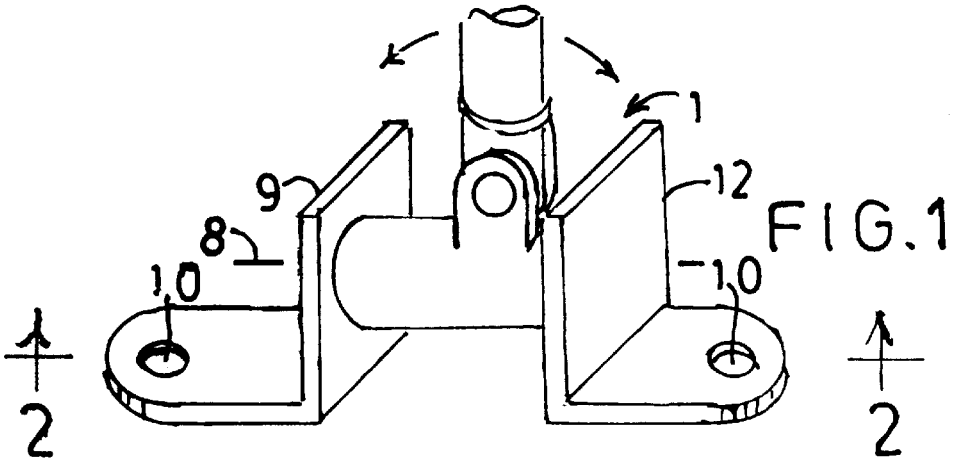
FIG. 1 is a perspective view of a bracket of the invention.
Figure 2:
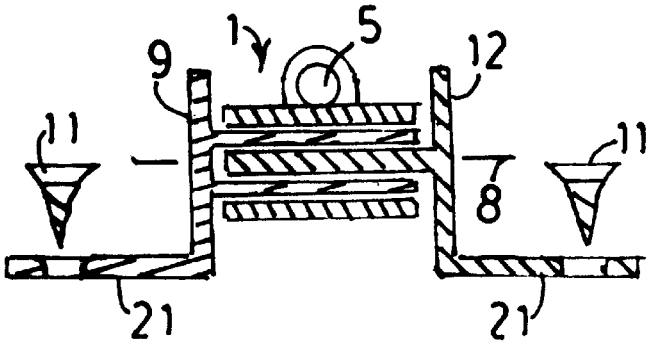
FIG. 2 is a sectional view taken on line 2—2 of FIG. 1.
Figure 3:
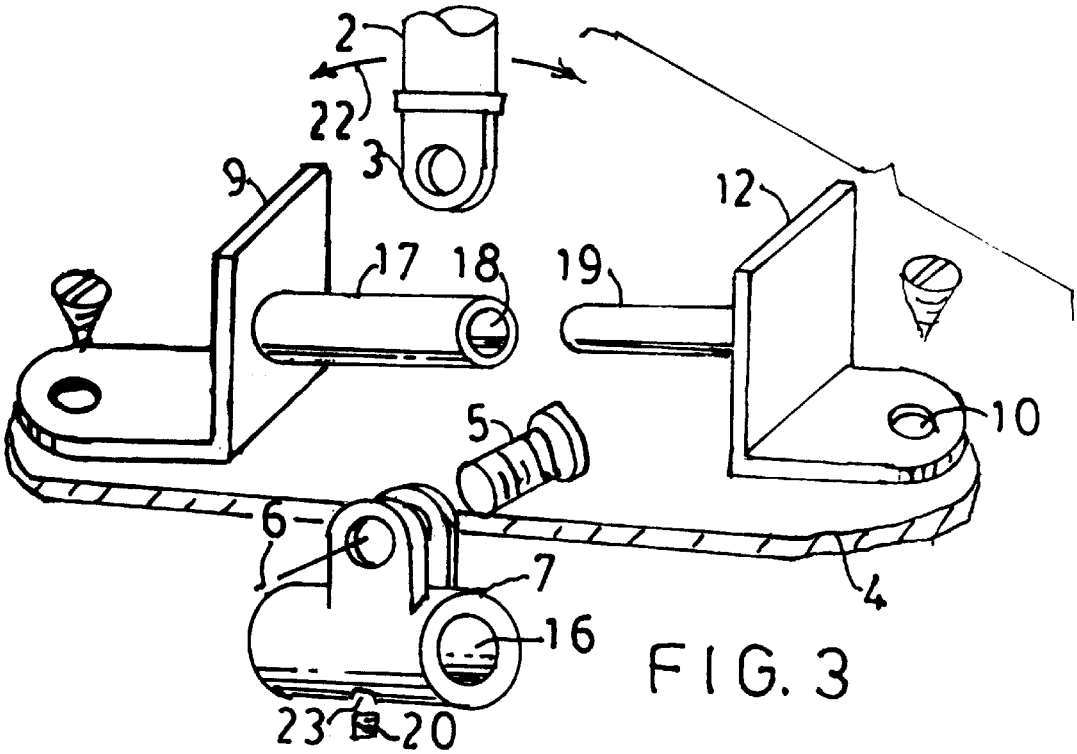
FIG. 3 is an exploded view of the bracket of FIG. 1.

Referring now first to FIGS. 1–3, the bracket 1 of the invention includes a first end element 9 and a second end element 12 each with a flat base 21 for mounting on a rigid support 4 by means of screws 11 in screw holes 10.

A cylindrical member 17 affixed to first end element 9 is provided with cylindrical channel 18 adapted for receiving therein cylindrical element 19 affixed to second end element 12.

Pivot pin 5 threadably attached to pivot pin support member 7 pivotally supports the end 3 of a tubular frame element 2 of an awning or canopy so that the element 2 rotates freely about the long axis 6 of pin 5 to deploy or collapse the frame and the awning or canopy by rotating through a plane indicated by arrows 22.

The pivot pin support member 7 is provided with a cylindrical passage 16 that receives the cylindrical member 17 therein so that the pivot pin support member 7 is rotatable about a long axis 8 that lies transverse to the long axis 6 of pivot pin 5. This enables the tubular element to rotate through more than a single plane as it folds or unfolds. This may be very useful in certain complex frames. Furthermore, the two end elements 9, 12 are also rotatable relative to one another about their common axis 8 so that their bases 21 may be more closely applied to rigid support surfaces that are not planar. Each end element is provided with a screw hole 10 for fastening the bracket to the support surface 4 by screws 11. A threaded aperture 23 may optionally be provided in support member 7 to receive setscrew 20 to prevent relative rotation between support member 7 and end element 9.

Figure 4:
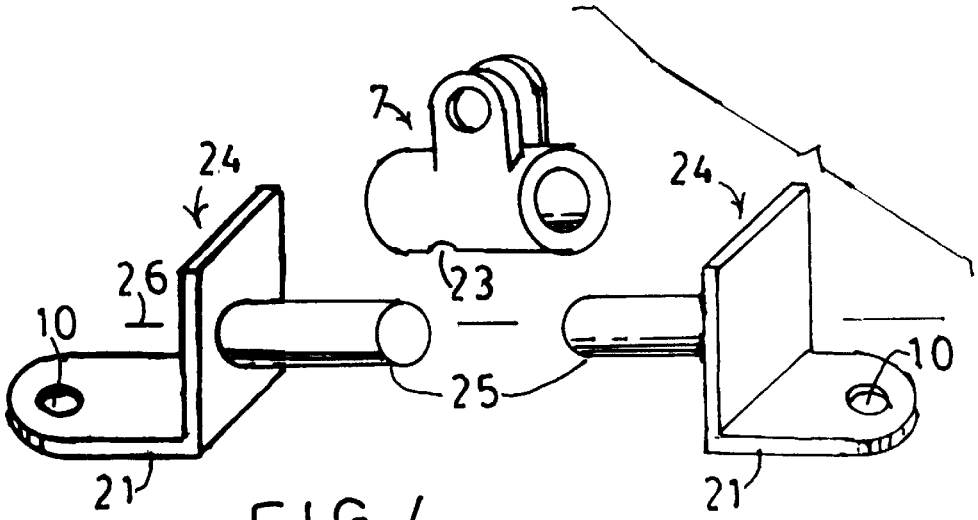
FIG. 4 is an exploded view of another embodiment of the invention.

Referring now to FIG. 4, an alternative embodiment of the invention comprises identical end elements 24 having flat bases 21 as above with screw holes 10. A cylindrical member 25 affixed to each end element supports the same pivot pin support member 7 as shown above, at each end so that the two ends 24 and support member 7 are rotatable relative to one another about the common axis 26.

Figure 5:
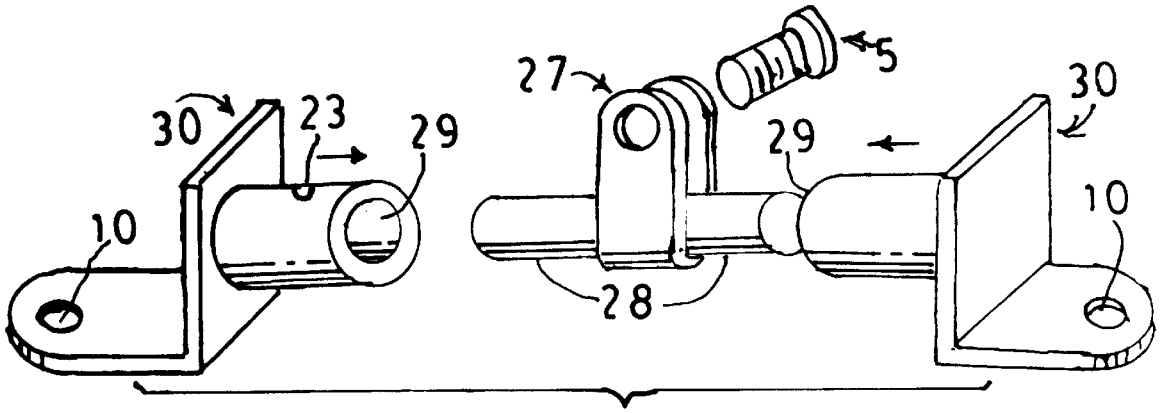
FIG. 5 is an exploded view of another embodiment of the invention.

Referring now to FIG. 5, an alternative embodiment of the invention comprises a pivot pin support member 27 having a solid cylindrical member 28 at each end thereof. Each of the identical end elements 30 is provided with a cylindrical passage 29 for rotably receiving therein one of the solid cylindrical members 28 so that each end member 30 and the pivot pin support member are rotatable about a common axis. Threaded hole 23 may be provided to receive a setscrew to prevent rotation of the pivot pin support member 27 relative to end element 30.

The above disclosed invention has a number of particular features which should preferably be employed in combination although each is useful separately without departure from the scope of the invention. While we have shown and described the preferred embodiments of our invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A bracket for pivotally supporting an end of a long tubular frame element on a rigid support surface, the bracket comprising:

A) a rigid pivot pin having a first long axis for friction free pivotal connection to an end of the long tubular frame element;

B) a rigid pivot pin support member having a pair of parallel opposed projections for receiving therebetween the end of the tubular frame element and for supporting said pivot pin, said pivot pin support member having an elongate second axis transverse to said first long axis;

C) a first rigid end element having means for fastening to said a rigid support surface;

D) a second rigid end element having means for fastening to said rigid support surface;

E) said first and second end elements supporting said pivot pin support member at opposed ends of said pivot pin support member and being freely rotatable relative to one another and to said pivot pin support member about said elongate second axis, to thereby enable the bracket to support friction free movement of said tubular frame element through more than a single plane and to facilitate fastening the bracket to a non-planar rigid surface.

2. The bracket according to claim 1 further comprising removable means transverse to said second axis interconnecting said pivot pin support member to at least one of said end elements to prevent relative rotation therebetween.

3. The bracket according to claim 1 wherein said pivot pin support member is provided with a cylindrical passage for receiving therein a cylindrical member attached to said first end element, and said cylindrical member is provided with a cylindrical channel for receiving therein a cylindrical element attached to said second end element.

4. The bracket according to claim 3 further comprising removable means interconnecting said pivot pin support member and said first end element to prevent relative rotation therebetween.

5. The bracket according to claim 1 wherein said pivot pin support member is provided with a cylindrical passage for receiving therein cylindrical members attached to said first and second end elements, the cylindrical passage and cylindrical members being coaxial about said elongate axis.

6. The bracket according to claim 1 wherein each of said end elements is provided with a cylindrical passage, and said pivot pin support member is provided with a cylindrical member at each end for mounting in each said cylindrical passage, the cylindrical members and passages cylindrical being coaxial about said elongate second axis.

7. The bracket according to claim 6 further comprising removable means interconnecting said pivot pin support member and at least one of said end elements for preventing relative rotation therebetween.

8. A bracket for pivotally supporting an end of a long tubular frame element on a rigid support surface, the bracket comprising:

A) a pivot pin having a first long axis for pivotal connection to an end of the long tubular frame element;

B) a pivot pin support member on which said pivot pin is mounted, said pivot pin support member having an elongate axis transverse to said first long axis;

C) a first end element having means for fastening to said a rigid support surface;

D) a second end element having means for fastening to said rigid support surface;

E) said first and second end elements supporting said pivot pin support member at opposed ends of said pivot support member, and being rotatable relative to one another and to sail pivot pin support member about said elongate axis, to thereby enable the bracket to support movement of said tubular frame element through more than a single plane and to facilitate fastening the bracket to a non-planar rigid surface; and wherein said pivot pin support member is provided with a cylindrical passage for receiving therein a cylindrical member attached to said first end element, and said cylindrical member is provided with a cylindrical channel for receiving therein a cylindrical element attached to said second end element.

9. The bracket according to claim 8 further comprising removable means interconnecting said pivot pin support member and said first end element to prevent relative rotation therebetween.

* * * * *